US007566390B2

(12) United States Patent
Woods

(10) Patent No.: US 7,566,390 B2
(45) Date of Patent: Jul. 28, 2009

(54) WAFER SUPPORT APPARATUS FOR ELECTROPLATING PROCESS AND METHOD FOR USING THE SAME

(75) Inventor: Carl Woods, Aptos, CA (US)

(73) Assignee: Lam Research Corporation, Fremont, CA (US)

( * ) Notice: Subject to any disclaimer, the term of this patent is extended or adjusted under 35 U.S.C. 154(b) by 854 days.

(21) Appl. No.: 11/014,527

(22) Filed: Dec. 15, 2004

(65) Prior Publication Data

US 2006/0124451 A1 Jun. 15, 2006

(51) Int. Cl.
*C25B 9/02* (2006.01)

(52) U.S. Cl. ..... 204/297.06; 204/198; 204/224 R; 204/228.1; 204/297.01; 204/297.09; 204/297.1; 204/297.14

(58) Field of Classification Search ..... 204/297.01, 204/297.06, 297.08, 297.09, 297.1, 297.14, 204/198, 224 R, 228.1
See application file for complete search history.

(56) References Cited

U.S. PATENT DOCUMENTS 5,522,975 A 6/1996 Andricacos et al.
6,090,711 A 7/2000 Batz, Jr. et al.
6,143,155 A 11/2000 Adams et al.
6,375,823 B1 4/2002 Matsuda et al.
6,495,005 B1 12/2002 Colgan et al.
6,527,925 B1 3/2003 Batz, Jr. et al.
2004/0020781 A1 2/2004 Dordi et al.
2005/0284767 A1* 12/2005 Dordi et al. ..... 205/157

* cited by examiner

*Primary Examiner*—Bruce F Bell
(74) *Attorney, Agent, or Firm*—Martine Penilla & Gencarella, LLP

(57) ABSTRACT

A multi-layered wafer support apparatus is provided for performing an electroplating process on a semiconductor wafer ("wafer"). The multi-layered wafer support apparatus includes a bottom film layer and a top film layer. The bottom film layer includes a wafer placement area and a sacrificial anode surrounding the wafer placement area. The top film layer is defined to be placed over the bottom film layer. The top film layer includes an open region to be positioned over a surface of the wafer to be processed, i.e., electroplated. The top film layer provides a liquid seal between the top film layer and the wafer, about a periphery of the open region. The top film layer further includes first and second electrical circuits that are each defined to electrically contact a peripheral top surface of the wafer at diametrically opposed locations about the wafer.

16 Claims, 10 Drawing Sheets

View A-A

View B-B

View C-C

View D-D

Views A-A and C-C

Views B-B and D-D

WAFER SUPPORT APPARATUS FOR ELECTROPLATING PROCESS AND METHOD FOR USING THE SAME

CROSS REFERENCE TO RELATED APPLICATIONS

This application is related to U.S. patent application Ser. No. 10/879,263, filed on Jun. 28, 2004, and entitled "Method and Apparatus for Plating Semiconductor Wafers," and U.S. patent application Ser. No. 10/879,396, filed on Jun. 28, 2004, and entitled "Electroplating Head and Method for Operating the Same." The disclosure of each of these related applications is incorporated herein by reference.

BACKGROUND OF THE INVENTION

1. Field of the Invention

The present invention relates to semiconductor fabrication.

2. Description of the Related Art

In the fabrication of semiconductor devices such as integrated circuits, memory cells, and the like, a series of manufacturing operations are performed to define features on semiconductor wafers. The semiconductor wafers include integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Also, patterned conductive layers are insulated from other conductive layers by dielectric materials.

The series of manufacturing operations for defining features on the semiconductor wafers can include an electroplating process for adding material to the surface of the semiconductor wafer. In the electroplating process, an electrolyte is disposed between an anode and the wafer surface to be electroplated. Additionally, the wafer surface to be electroplated is maintained at a lower voltage potential than the anode. As an electric current flows through the electrolyte from the anode to the wafer surface, electroplating reactions occurring at the wafer surface cause material to be deposited on the wafer surface.

Material deposition characteristics across the wafer surface are dependent on many parameters associated with the particular electroplating system and process. For example, parameters affecting the electrical current profile across the wafer can influence the material deposition characteristics. Also, parameters related to establishment of electrical contact with the wafer can influence the material deposition characteristics.

In view of the foregoing, there is a continuing need to improve electroplating technology as applicable to material deposition during semiconductor wafer fabrication.

SUMMARY OF THE INVENTION

In one embodiment, a multi-layered wafer handling system for use in an electroplating process is disclosed. The multi-layered wafer handling system includes a bottom film layer and a top film layer. The bottom film layer includes a wafer placement area and a sacrificial anode surrounding the wafer placement area. The top film layer is defined to be placed over the bottom film layer. The top film layer includes an open region to be positioned over a surface of the wafer to be processed, i.e., electroplated. The top film layer is defined to provide a liquid seal between the top film layer and the wafer, about a periphery of the open region. The top film layer further includes first and second electrical circuits defined to electrically contact a peripheral top surface of the wafer at diametrically opposed locations.

In another embodiment, a wafer support apparatus for use in an electroplating process is disclosed. The wafer support apparatus includes a first material layer having an area for receiving a wafer to be processed. The wafer support apparatus also includes a sacrificial anode defined over the first material layer. The wafer support apparatus further includes a second material layer configured to overlie both a peripheral region of the wafer and the first material layer outside the peripheral region of the wafer. The second material layer includes a cutout to expose a surface of the wafer to be processed, i.e., electroplated. The second material layer is further configured to form a seal between the second material layer and the peripheral region of the wafer. Additionally, the wafer support apparatus includes a pair of circuits integrated within the second material layer. Each circuit in the pair of circuits includes an electrical contact defined to electrically connect with the surface of the wafer to be processed. Furthermore, the pair of circuits is electrically isolated from the sacrificial anode.

In another embodiment, a method for supporting a wafer in an electroplating process is disclosed. The method includes placing a wafer between a bottom film layer and a top film layer, wherein a surface of the wafer to be processed is exposed through an opening in the top film layer. The method also includes establishing a liquid seal between the top film layer and a periphery of the wafer. Additionally, the method includes establishing an electrical connection between a first electrical circuit and a first peripheral location of the wafer. The first electrical circuit is integral to the top film layer. The method further includes establishing an electrical connection between a second electrical circuit and a second peripheral location of the wafer. The second peripheral location is diametrically opposed about the wafer to the first peripheral location. Also, the second electrical circuit is integral to the top film layer. The bottom and top film layers having the wafer placed therebetween are positioned on a platen of an electroplating system. An operation is then provided to traverse the platen below a processing head of the electroplating system. Traversal of the platen causes the surface of the wafer exposed through the opening in the top film layer to be electroplated.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which.

DETAILED DESCRIPTION

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1A:
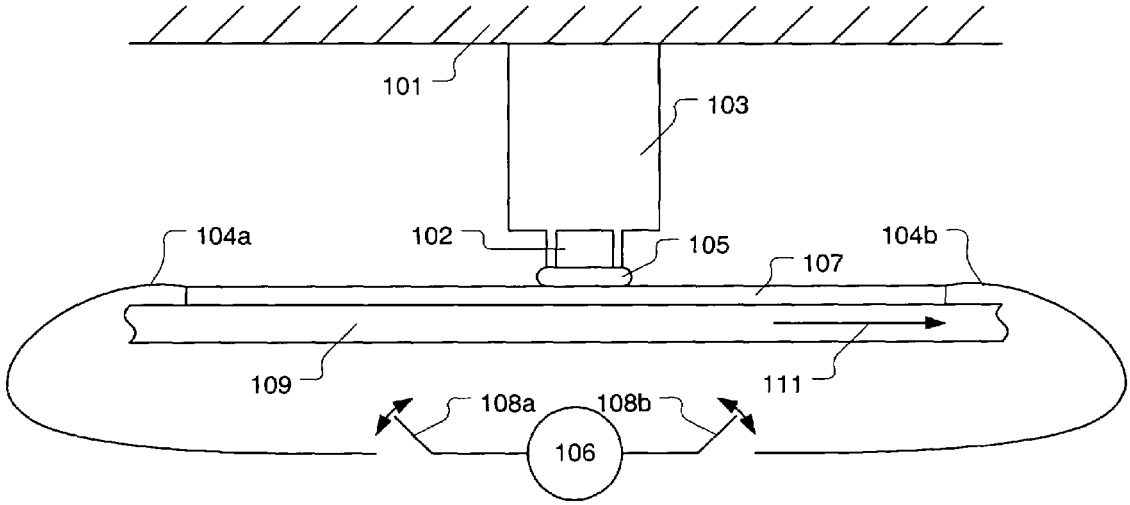
FIG. 1A is an illustration showing an apparatus for electroplating a semiconductor wafer, in accordance with one embodiment of the present invention.

FIG. 1A is an illustration showing an apparatus for electroplating a semiconductor wafer, in accordance with one embodiment of the present invention. The apparatus includes a platen 109 configured to securely hold a wafer 107. The platen 109 is movable in a horizontal plane as indicated by arrow 111. The apparatus also includes a first electrical connection 104*a* for connecting a power source 106 to the wafer 107 at a first location. The apparatus further includes a second electrical connection 104*b* for connecting the power source 106 to the wafer 107 at a second location. The first location on the wafer 107 corresponding to the first electrical connection 104*a* is located at a substantially diametrically opposed position from the second location corresponding to the second electrical connection 104*b*, with respect to a diameter of the wafer 107. Each of the first and second electrical connections 104*a*/104*b* includes a respective switch 108*a*/108*b*. The switches 108*a*/108*b* allow the first and second electrical connections 104*a*/104*b* to be controlled independently from each other. In one embodiment, either the first electrical connection 104*a* or the second electrical connection 104*b* that is farthest from a processing head 103 is powered at a given time.

The processing head 103 is secured to a rigid member 101. The platen 109 having the wafer 107 disposed thereon is positioned underneath the processing head 103, such that the wafer 107 is substantially parallel with and in close proximity to a lower surface of the processing head 103. The processing head 103 includes an anode 102 defining a major portion of the processing head 103 lower surface that is proximate to the wafer 107.

In one embodiment, a horizontal surface of the anode 102 facing the wafer 107 is defined to have a substantially rectangular surface area that is considerably parallel to the wafer 107. This rectangular surface area of the anode 102 is defined to have a first dimension that is at least equal to the diameter of the wafer 107. With respect to the view shown in FIG. 1A, the first dimension of the rectangular surface area of the anode 102 extends into the page. The rectangular surface area of the anode 102 also includes a second dimension that is defined to be less than the diameter of the wafer 107. In one embodiment, this second dimension is substantially less than the diameter of the wafer 107. With respect to the view shown in FIG. 1A, the second dimension of the rectangular surface area of the anode 102 extends at a right angle to the previously discussed first dimension and parallel to the platen 109.

When the anode 102 is disposed over the wafer 107, the first dimension, i.e., the long dimension, of the rectangular surface area of the anode 102 extends along a first chord defined across the wafer 107, such that the anode 102 extends completely across the wafer in the direction of the first chord. Also, the second dimension, i.e., the short dimension, of the rectangular surface area of the anode 102 extends in a direction of a second chord defined across the wafer 107, wherein the second chord is perpendicular to the first chord. Additionally, the wafer 107 is positioned on the platen 109 such that the second chord is substantially parallel to a line extending between the first location on the wafer 107 corresponding to connection 104*a* and the second location on the wafer 107 corresponding to connection 104*b*. It should be understood that regardless of the position of the anode 102 over the wafer 107, the anode 102 will not completely extend across the wafer 107 in the direction of the second chord.

The platen 109 is configured to be moved in the horizontal direction 111 underneath the processing head 103 such that a substantially uniform distance is maintained between the platen 109 and the anode 102. In one embodiment, the substantially uniform distance between the platen 109 and the anode 102 is maintained to have a variation of less than 0.200 inch over the entire traversal distance of the platen 109. In another embodiment, the substantially uniform distance between the platen 109 and the anode 102 is maintained to have a variation of less than 0.002 inch over the entire traversal distance of the platen 109. It should be appreciated that the substantially uniform distance maintained between the platen 109 and the anode 102 corresponds to an equally uniform distance maintained between the wafer 107 and the anode 102. Additionally, the wafer 107 is positioned on the platen 109 such that as the platen 109 is moved underneath the processing head 103, the anode 102 traverses the wafer 107 in a direction corresponding to the second chord as previously described. Therefore, the anode 102 is capable of traversing over an entirety of the top surface of the wafer 107 as the platen 109 is moved horizontally.

The distance between the rectangular surface area of the anode 102 and the wafer 107 is sufficient to allow a meniscus 105 of electroplating solution to be maintained between the anode 102 and the top surface of the wafer 107 as the wafer 107 travels underneath the anode 102. Additionally, the meniscus 105 can be contained within a volume directly below the anode 102. Containment of the meniscus 105 can be accomplished in a variety of ways as discussed in the cross-referenced U.S. patent application Ser. No. 10/879,263.

In one embodiment, the anode 102 is defined as a virtual anode represented as a porous resistive material. In this embodiment, the meniscus 105 of electroplating solution can be applied to the volume directly below the virtual anode 102 by flowing cation laden electroplating solution through the porous virtual anode 102. This embodiment is further described in the cross-referenced U.S. patent application Ser. No. 10/879,263. In one embodiment the porous virtual anode 102 can be defined by a ceramic such as $Al_2O_3$. It should be appreciated, however, that other porous resistive materials can be used to define the anode 102. A more detailed explanation of the porous virtual anode is provided in the cross-referenced U.S. patent application Ser. No. 10/879,396.

It should be appreciated that during operation of the apparatus of FIG. 1A, the anode 102 and one of the first and second electrical connections 104*a* and 104*b* are electrically connected to a power supply such that a voltage potential exists therebetween. Thus, when the meniscus 105 of electroplating solution is present between the anode 102 and the wafer 107, and either the first or second electrical connection 104*a*/104*b* is powered, an electric current will flow between the anode 102 and the powered electrical connection 104*a*/104*b*. This electric current enables electroplating reactions to occur at portions of the top surface of the wafer 107 that are exposed to the meniscus 105 of electroplating solution.

Figure 1B:
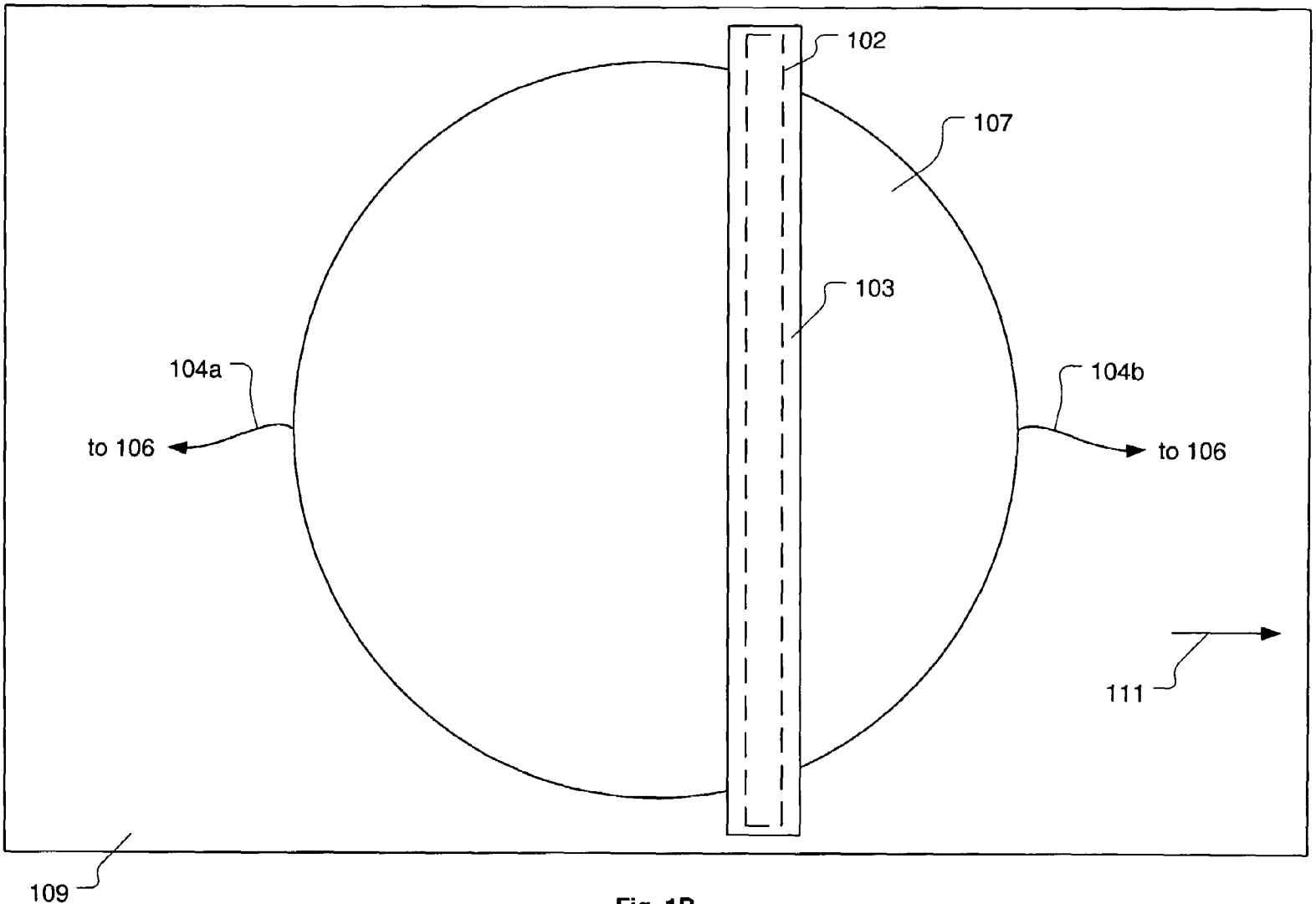
FIG. 1B is an illustration showing a top view of the processing head and anode relative to the platen and wafer, as previously depicted in FIG. 1A.

FIG. 1B is an illustration showing a top view of the processing head 103 and anode 102 relative to the platen 109 and wafer 107, as previously depicted in FIG. 1A. As previously discussed, the anode 102 extends completely across the wafer 107 in the direction of its long dimension. Thus, as the wafer 107 traverses in direction 111 underneath the anode 102, the entire top surface of the wafer 107 will be exposed to the meniscus 105 of electroplating solution present below the anode 102. Additionally, it should be apparent from FIG. 1B that the anode 102 traverses the wafer 107 in a direction corresponding to the second chord as previously described, i.e., in the direction of the short dimension of the anode 102 rectangular surface area that is facing the top surface of the wafer 107. Furthermore, it should be apparent from FIG. 1B that the second chord is substantially parallel to a line extending between the first location on the wafer 107 corresponding to the electrical connection 104*a* and the second location on the wafer 107 corresponding to the electrical connection 104*b*.

During the electroplating process, a uniformity of the deposited material is governed by a current distribution at an area of the wafer being plated, i.e., the interface between the meniscus 105 of electroplating solution and the wafer 107. The current distribution at the area being plated can be strongly influenced by a proximity of the anode 102 to the powered electrical connection 104*a*/104*b* made with the wafer 107. Also, the current distribution can be effected by the quality of the electrical connections 104*a*/104*b* made with the wafer 107. Furthermore, exposure of the electrical connections 104*a*/104*b* to the electroplating solution can cause removal of material from the wafer surface in a vicinity of the electrical connections 104*a*/104*b*. Additionally, exposure of the electrical connections 104*a*/104*b* to the electroplating solution can introduce wafer-to-wafer non-uniformities with respect to the material deposition results.

In view of the foregoing, it is desirable to support the wafer 107 during the electroplating process with the following considerations addressed:

establishing independently controllable electrical connections 104*a*/104*b* such that the electrical connection 104*a*/104*b* farthest from the anode 102 can be powered while the electrical connection 104*a*/104*b* closest to the anode 102 is de-powered, preventing the electrical connections 104*a*/104*b* made with the wafer from being exposed to the electroplating solution, and ensuring that the physical characteristics of the electrical connections 104*a*/104*b* made with the wafer are uniform from wafer-to-wafer.

The present invention provides a wafer support apparatus and associated method of use that addresses the above considerations concerning the electroplating process. More specifically, the wafer support apparatus of the present invention uses embedded contact circuitry in a multi-layered thin film configuration to address the above considerations. As will be further discussed below with respect to FIGS. 2A-2C and 3A-3C, each layer of the multi-layered thin film includes the following components:

a separate copper circuit (either exposed or embedded) having an externally accessible portion for connection to a power supply, an open area for exposing the wafer, a masked area (either conductive or non-conductive) for providing a liquid seal to prevent corruption of electrode connections to the wafer by the electroplating solution, and index points, i.e., tooling targets, to facilitate proper wafer and film placement.

Figure 2A:
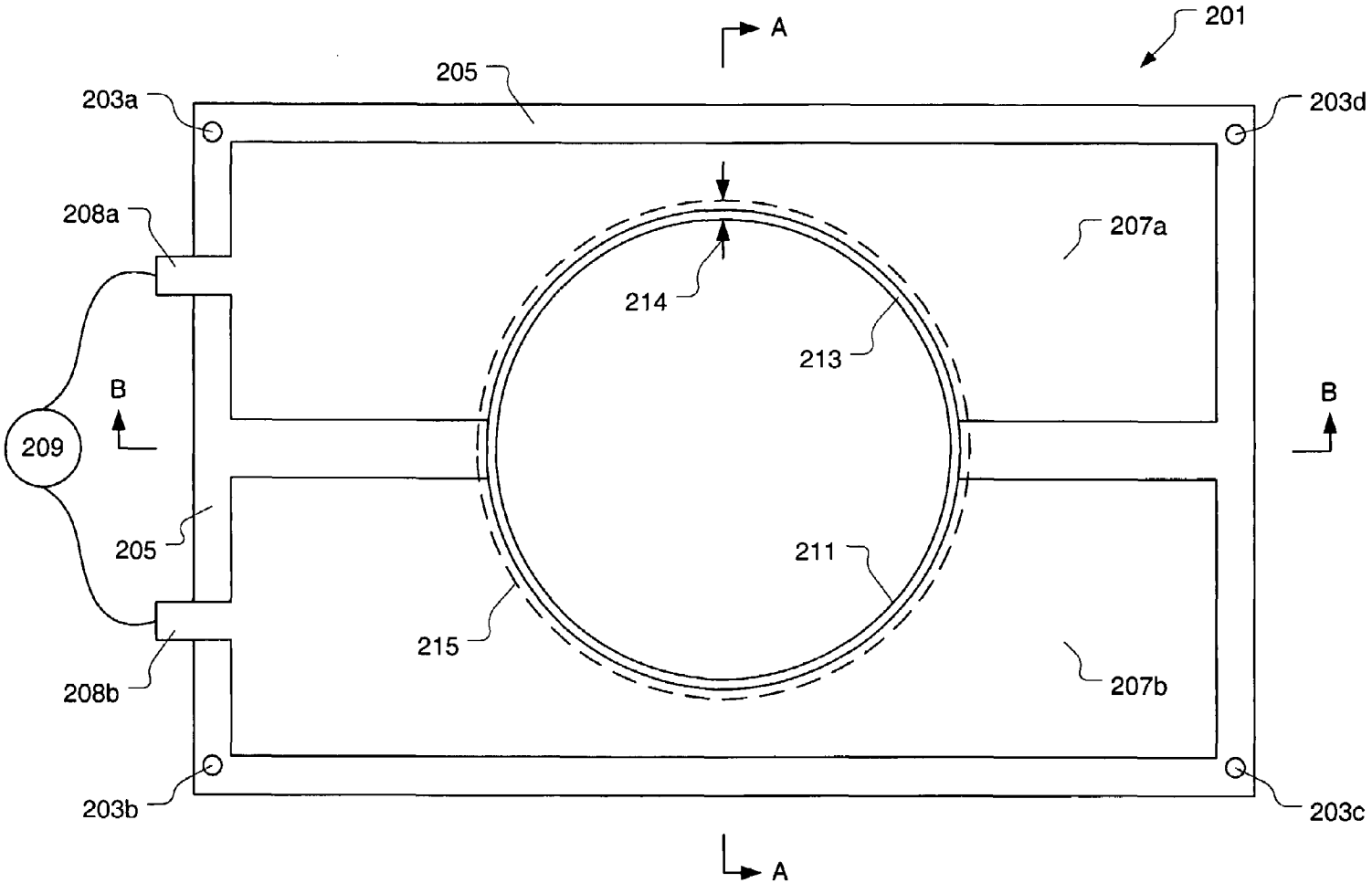
FIG. 2A is an illustration showing a top view of a bottom layer of a multi-layered wafer support apparatus, in accordance with one embodiment of the present invention.

FIG. 2A is an illustration showing a top view of a bottom layer 201 of a multi-layered wafer support apparatus, in accordance with one embodiment of the present invention. The bottom layer 201 is defined primarily by a thin film 205. In various embodiments, the thin film 205 is defined by an amorphous film material such as Ajedium Victrex PEEK, polyetherimide (PEI), polysulfone (PSU), or polyphenylsulfide (PPS). In one embodiment, the thin film 205 is formed using a thermoplastic process.

The bottom layer 201 of the multi-layered wafer support apparatus is defined as a continuous member including a circular cutout 211 having a diameter that is slightly less than a diameter of the wafer 107. For reference, a diameter 215 of the wafer 107 is shown in FIG. 2A as a dashed line. A lower mask region 214 is defined around the periphery of the cutout 211 and extending radially to about the diameter 215 of the wafer 107. In one embodiment, the lower mask region 214 radial thickness is about 2 mm. In another embodiment, the lower mask region 214 radial thickness is defined within a range extending from about 0.5 mm to about 5.0 mm. As used herein, the term "about" means within ±10% of a specified value.

The wafer 107 is to be placed over the bottom layer 201 in a position substantially centered over the cutout 211. Therefore, the lower mask region 214 serves to mask a bottom peripheral region of the wafer 107. Additionally, the lower mask region 214 is referred to as a wafer placement area. To prevent electroplating solution from entering the region between the film layers of the multi-layered wafer support apparatus, the lower mask region 214 includes a sealant region 213. The sealant region 213 can include an adhesive that is properly formulated to be chemically compatible with the wafer 107 and electroplating solution. In one embodiment, the adhesive is also formulated to enable removal/cleaning of the adhesive from the wafer 107 following the electroplating process.

The bottom layer 201 includes index points 203*a*-203*d* for ensuring proper placement of the multi-layered wafer support and wafer 107 with respect to the processing head 103 during the electroplating process. The embodiment of FIG. 2A shows four index points (203*a*-203*d*). However, the number and location of index points can be defined as necessary to achieve proper positioning of the multi-layered wafer support apparatus and wafer 107 on the platen 109. For example, in another embodiment, two index points are provided on one end of the bottom layer 201, and one index point is provided on the opposite end of the bottom layer 201. Index points can also be provided to assist in proper placement of the wafer 107 on the bottom layer 201, i.e., within the lower mask region 214. It should be further appreciated that tooling pins can be provided on the platen 109 to match the index points of the bottom layer 201.

As the wafer 107 traverses underneath the anode 102, portions of the anode 102 will be disposed outside a periphery of the wafer 107 and over the platen bottom layer 201. If the bottom layer 201 is not maintained at a voltage potential near that of the wafer 107, electrical current emanating from the portions anode 102 disposed outside the periphery of the wafer 107 will be directed to the wafer 107, thus causing a non-uniformity, i.e., excess, in electrical current to exist near the edge of the wafer 107. The excess electrical current near the edge of the wafer 107 can result in excessive copper deposition near the edge of the wafer 107, i.e., a fringing effect. Consequently, the material deposition across the entire wafer will be non-uniform. If the region surrounding the wafer 107 is maintained at or near the same potential as the wafer 107, the electrical current emanating from the anode 102 will be directed evenly toward both the wafer and the region surrounding the wafer, thus minimizing the fringing effect.

To combat the fringing effect, the electrical current needs to be attracted to the bottom layer 201 region surrounding the wafer 107. Therefore, the bottom layer 201 further includes a sacrificial anode (207*a*/207*b*) defined as a patterned copper layer disposed on the bottom layer 201. The sacrificial anode (207*a*/207*b*) is defined as a first portion 207*a* and a second portion 207*b* to allow for separation from other electrical circuits to be disposed over the bottom layer 201, as will be discussed with respect to FIG. 3A. In one embodiment, the sacrificial anode portions 207*a*/207*b* can approach within about 0.005 inch of the edge of the wafer. In another embodiment, a dielectric material can be used to separate the sacrificial anode portions 207*a*/207*b* from the wafer 107 within the lower mask region 214 such that the sacrificial anode portions 207*a*/207*b* can extend under the peripheral edge of the wafer 107. The sacrificial anode portions 207*a*/207*b* should extend sufficiently beyond the periphery of the lower mask region 214 to ensure that electrical current uniformity is maintained between the anode 102 and the periphery of the wafer 107 during traversal of the wafer 107 underneath the anode 102. In one embodiment, the sacrificial anode portions 207*a*/207*b* extend over the bottom layer 201 between locations where the anode 102 resides at the beginning and the end of the electroplating process.

In one embodiment, the sacrificial anode portions 207*a*/207*b* are defined using an adhesive backed copper tape secured to the bottom layer 201. In another embodiment, the sacrificial anode portions 207*a*/207*b* are defined within the bottom layer 201 during manufacture of the bottom layer 201. In another embodiment, the bottom layer 201 is formed from two layers of amorphous film material, wherein the sacrificial anode portions 207*a*/207*b* are defined by a copper layer disposed between the two layers of amorphous film material. In yet another embodiment, the bottom layer 201 is formed from a copper clad amorphous film, wherein the amorphous film is impregnated with a sufficient amount of copper to be electrically conductive. Additionally, electrical contacts 208*a* and 208*b* are provided for supplying power to the sacrificial anode portions 207*a* and 207*b*, respectively. These sacrificial anode electrical contacts 208*a*/208*b* can be located at any position around the periphery of the bottom layer 201 as required to coordinate with other features of the multi-layered wafer support apparatus and electroplating system.

The sacrificial anode electrical contacts 208*a*/208*b* are defined to be connected with a common sacrificial anode power supply 209. It should be appreciated that separate power supplies can be used to control the voltage potential of the sacrificial anode (207*a*/207*b*) and the wafer 107, respectively. Therefore, the voltage potential of the sacrificial anode (207*a*/207*b*) can be controlled separately from the voltage potential of the wafer 107. Thus, the fringing effect can be controlled through independent control of the sacrificial anode (207*a*/207*b*) voltage potential relative to the wafer 107 voltage potential.

Figure 2B:
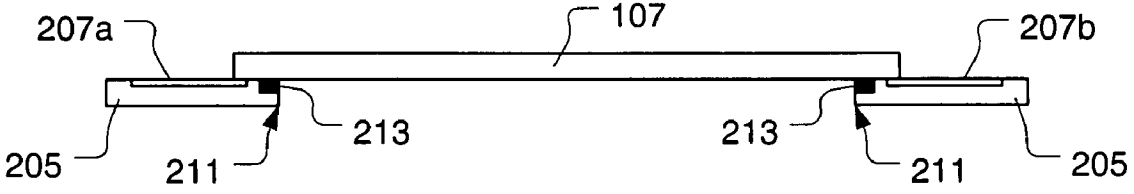
FIG. 2B is an illustration showing a cross-sectional view of the bottom layer corresponding to callouts A-A in FIG. 2A, in accordance with one embodiment of the present invention.

FIG. 2B is an illustration showing a cross-sectional view of the bottom layer 201 corresponding to callouts A-A in FIG. 2A, in accordance with one embodiment of the present invention. Thus, FIG. 2B is a cross-sectional view corresponding to a plane extending vertically through the center of the circular cutout 211 and perpendicularly to a long edge of the bottom layer 201. The circular cutout 211 below the wafer 107 allows the wafer 107 to be held directly on the platen 109 (not shown). Holding the wafer 107 directly on the platen 109 avoids issues associated with ensuring that the bottom layer 201 does not introduce non-uniformities in the positioning of the wafer 107 with respect to the processing head 103 and anode 102. Because the lower mask region 214 introduces a separation thickness between the wafer 107 and the platen 109, the platen 109 can be defined to fit within the circular cutout 211 and against the bottom of the wafer 107. In one embodiment, the platen 109 includes a number of height-adjustable pins that can be raised to engage the bottom of the wafer 107 and lowered to disengage from the wafer 107. In another embodiment, the platen 109 can include a raised island region defined to fit within the circular cutout 211 and engage the bottom of the wafer 107.

Figure 2C:
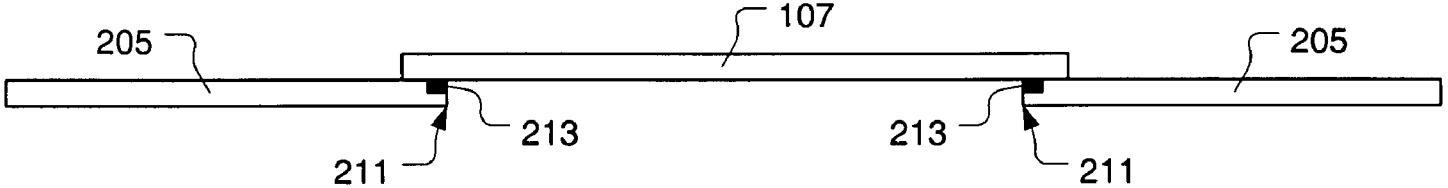
FIG. 2C is an illustration showing a cross-sectional view of the bottom layer corresponding to callouts B-B in FIG. 2A, in accordance with one embodiment of the present invention.

FIG. 2C is an illustration showing a cross-sectional view of the bottom layer 201 corresponding to callouts B-B in FIG. 2A, in accordance with one embodiment of the present invention. Thus, FIG. 2C is a cross-sectional view corresponding to a plane extending vertically through the center of the circular cutout 211 and perpendicularly to a short edge of the bottom layer 201. It should be appreciated that each of the components of the bottom layer 201 as illustrated in FIG. 2C is the same as previously described with respect to FIG. 2A.

Figure 3A:
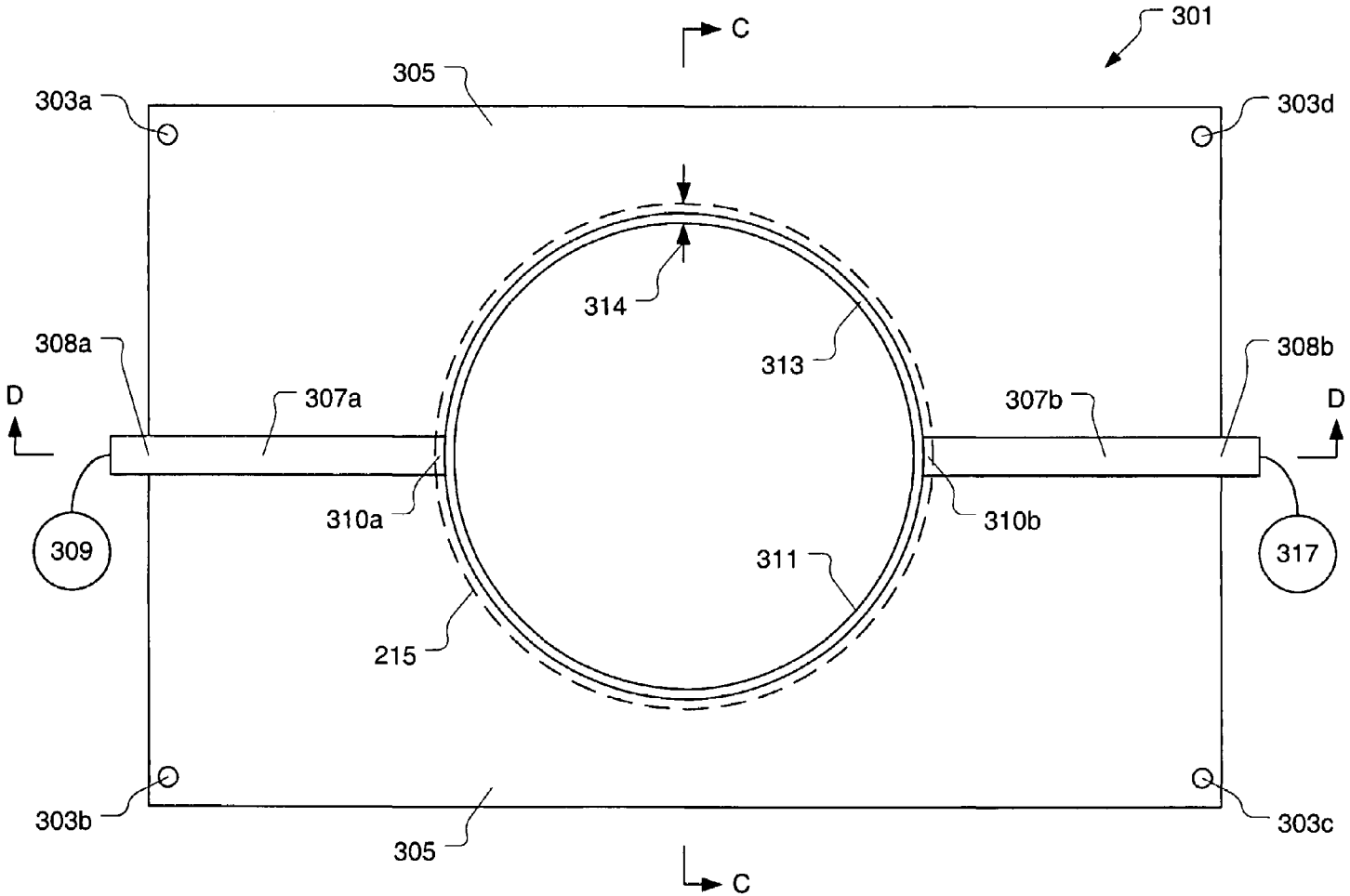
FIG. 3A is an illustration showing a bottom view of a top layer of a multi-layered wafer support apparatus, in accordance with one embodiment of the present invention.

FIG. 3A is an illustration showing a bottom view of a top layer 301 of a multi-layered wafer support apparatus, in accordance with one embodiment of the present invention. The top layer 301 is defined primarily by a thin film 305. In various embodiments, the thin film 305 is defined by an amorphous film material such as Ajedium Victrex PEEK, polyetherimide (PEI), polysulfone (PSU), or polyphenylsulfide (PPS). In one embodiment, the thin film 305 is formed using a thermoplastic process.

The top layer 301 of the multi-layered wafer support apparatus is defined as a continuous member including a circular cutout 311 having a diameter that is slightly less than the diameter of the wafer 107. For reference, the diameter 215 of the wafer 107 is shown in FIG. 3A as a dashed line. In one embodiment, the diameter of the cutout 311 is defined to have a tolerance of +0.0025 inch and minus zero. An upper mask region 314 is defined around the periphery of the cutout 311 and extending radially to about the diameter 215 of the wafer 107. In one embodiment, the upper mask region 314 radial thickness is defined to cover between about 0.5 mm and about 5.0 mm of the periphery of the wafer 107, i.e., within an exclusion boundary defined around the peripheral edge of the wafer.

The top layer 301 is to be placed over the wafer 107 such that the cutout 311 is substantially centered over the wafer 107. Thus, the top surface of the wafer 107 to be exposed to the electroplating process is made accessible through the cutout 311. Therefore, the upper mask region 314 serves to mask a top peripheral region of the wafer 107. To prevent electroplating solution from entering the region between the film layers of the multi-layered wafer support apparatus, the upper mask region 314 includes a sealant region 313. The sealant region 313 can include an adhesive that is properly formulated to be chemically compatible with the wafer 107 and electroplating solution. In one embodiment, the adhesive is also formulated to enable removal/cleaning of the adhesive from the wafer 107 following the electroplating process.

The top layer 301 includes index points 303*a*-303*d* for ensuring proper placement of the multi-layered wafer support and wafer 107 with respect to the processing head 103 during the electroplating process. The embodiment of FIG. 3A shows four index points (303*a*-303*d*). However, the number and location of index points can be defined as necessary to achieve proper positioning of the multi-layered wafer support apparatus and wafer 107 on the platen 109. For example, in another embodiment, two index points are provided on one end of the top layer 301, and one index point is provided on the opposite end of the top layer 301. Index points can also be provided to assist in proper placement of the top layer 301 over the wafer 107, i.e., within the upper mask region 314. It should be further appreciated that tooling pins can be provided on the platen 109 to match the index points of the top layer 301.

The top layer 301 also includes a first electrical circuit 307*a* and a second electrical circuit 307*b*. The first electrical circuit 307*a* is defined to contact the top surface of the wafer 107 at a first location 310*a* that is outside the sealant region 313 and within the upper mask region 314. The second electrical circuit 307*b* is defined to contact the top surface of the wafer 107 at a second location 310*b* that is outside the sealant region 313 and within the upper mask region 314. Each of the first and second electrical circuits (307*a* and 307*b*) include a respective electrical contact (308*a* and 308*b*). The electrical contacts 308*a*/308*b* can be located at any position around the periphery of the top layer 301 as required to coordinate with other features of the multi-layered wafer support apparatus and electroplating system. Each of the electrical contacts 308*a* and 308*b* is connected to a power supply 309 and 317, respectively.

Each of the power supplies 309 and 317 are independently controllable, such that power can be independently supplied through the first and second electrical circuits to the wafer contact locations 310*a* and 310*b*. During the electroplating process, electrical current being applied to the wafer 107 edge at the contact locations 310*a* and 310*b* can be controlled to establish a particular electrical current profile across the wafer 107. For example, as the wafer 107 traverses underneath the anode 102, the contact location (310*a*/310*b*) farthest from the anode 102 can be powered while the contact location (310*a*/310*b*) closest to the anode 102 is de-powered.

In one embodiment, the first and second electrical circuits 307*a*/307*b* are defined using an adhesive backed copper tape secured to the top layer 301. In another embodiment, the first and second electrical circuits 307*a*/307*b* are defined within the top layer 301 during manufacture of the top layer 301. In another embodiment, the top layer 301 is formed from two layers of amorphous film material, wherein the first and second electrical circuits 307*a*/307*b* are defined by a copper layer disposed between the two layers of amorphous film material. In yet another embodiment, the first and second electrical circuits 307*a*/307*b* are formed from a copper clad amorphous film, wherein the amorphous film is impregnated with a sufficient amount of copper to be electrically conductive. Additionally, in one embodiment, the portions of the first and second electrical circuits 307*a*/307*b* that contact the wafer 107 at the contact locations 310*a*/310*b* are defined by an electrically conductive adhesive that ensures proper electrical contact is achieved and maintained with the wafer 107. The conductive adhesive can also be used to ensure that consistent electrical contact is established from wafer-to-wafer.

The embodiment of FIG. 3A is shown to include two electrical circuits 307*a* and 307*b*. However, it should be appreciated that any number of electrical circuits can be defined to electrically contact the wafer 107 at a number of locations around the periphery of the wafer 107. Also, in other embodiments, the contact area established between a particular electrical circuit and the top surface of the wafer can be larger or smaller. It should be appreciated that the number of electrical circuits contacting the wafer 107, and the contact area size between each electrical circuit and the wafer 107, will have a corresponding effect on the electrical current profile across the wafer 107 relative to the anode 102. Therefore, the number and characteristics of the electrical circuits can be optimized to achieve a desired electrical current profile across the wafer 102 relative to a given location of the anode 102 over the wafer 107. For example, as the wafer 107 moves relative to the anode 102, different electrical circuits can be energized and de-energized to beneficially manipulate the electrical current profile across the wafer 107 relative to the anode 102.

Figure 3B:
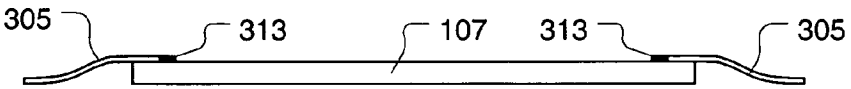
FIG. 3B is an illustration showing a cross-sectional view of the top layer corresponding to callouts C-C in FIG. 3A, in accordance with one embodiment of the present invention.

FIG. 3B is an illustration showing a cross-sectional view of the top layer 301 corresponding to callouts C-C in FIG. 3A, in accordance with one embodiment of the present invention. Thus, FIG. 3B is a cross-sectional view corresponding to a plane extending vertically through the center of the circular cutout 311 and perpendicularly to a short edge of the top layer 301. It should be appreciated that each of the components of the top layer 301 as illustrated in FIG. 3B is the same as previously described with respect to FIG. 3A.

Figure 3C:
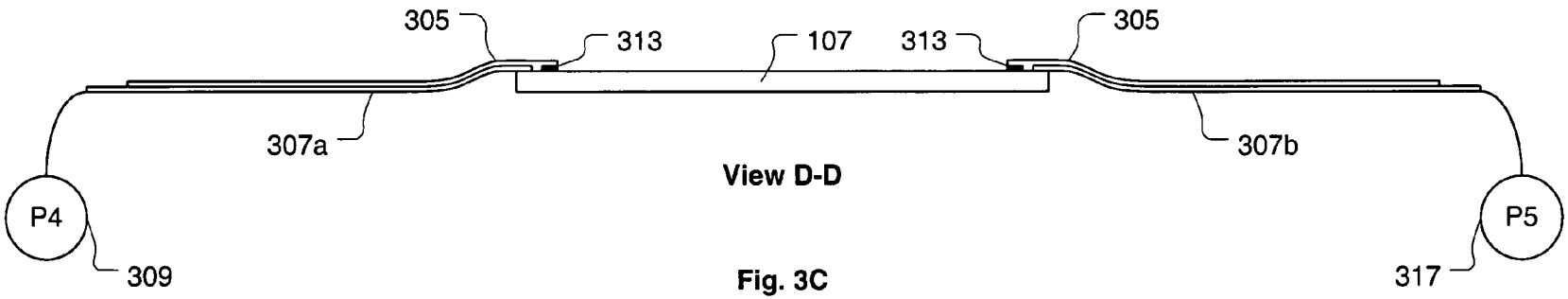
FIG. 3C is an illustration showing a cross-sectional view of the top layer corresponding to callouts D-D in FIG. 3A, in accordance with one embodiment of the present invention.

FIG. 3C is an illustration showing a cross-sectional view of the top layer 301 corresponding to callouts D-D in FIG. 3A, in accordance with one embodiment of the present invention. Thus, FIG. 3C is a cross-sectional view corresponding to a plane extending vertically through the center of the circular cutout 311 and perpendicularly to a long edge of the top layer 301. It should be appreciated that each of the components of the top layer 301 as illustrated in FIG. 3C is the same as previously described with respect to FIG. 3A.

In one embodiment, a throw-away film (consumable layer) is provided to protect the lower mask region 214 prior to placement of the wafer 107 on the bottom layer 201. A consumable layer can also be provided to protect the upper mask region 314 prior to placement of the top layer 301 over the wafer 107/bottom layer 201. The consumable layers can be peeled away from the bottom/top layers to expose the lower/upper mask regions. It should be appreciated that the consumable layer protecting the upper mask region 314 provides protection for the electrical circuits 307*a*/307*b* in the upper mask region prior to contacting the wafer 107. The consumable layers can be defined by an amorphous film material similar to that used to define the thin films 205/305.

Figure 4A:
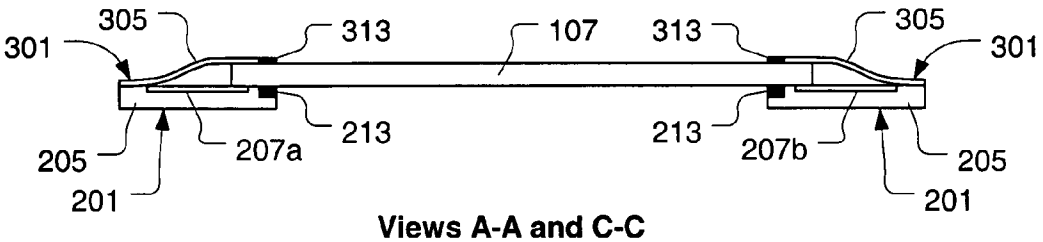
FIG. 4A is an illustration showing an assembly of the multi-layered wafer support apparatus, in accordance with one embodiment of the present invention.

FIG. 4A is an illustration showing an assembly of the multi-layered wafer support apparatus, in accordance with one embodiment of the present invention. The view depicted in FIG. 4A corresponds to View A-A of the bottom layer 201 as previously shown in FIG. 2B and View C-C of the top layer 301 as previously shown in FIG. 3B. It should be appreciated that each of the components of the bottom layer 201 and top layer 301, as illustrated in FIG. 4A, is the same as previously described with respect to FIGS. 2A and 3A, respectively. The wafer 107 is shown as being sandwiched between the bottom layer 201 and the top layer 301. It should be appreciated that the bottom and top layers 201/301 are independently positionable with respect to each other. Furthermore, as previously discussed, each of the bottom and top layers 201/301 include a number of index points to facilitate their proper alignment with respect to the wafer 107 and the platen 109.

In one embodiment, each layer of the multi-layered wafer support apparatus has a thickness within a range extending from about 0.002 inch to about 0.030 inch. Additionally, the bottom layer 201 can have a different thickness than the top layer 301. In one embodiment, a total thickness of the wafer 107 and the multi-layered wafer support apparatus is less than 0.5 mm. In a further embodiment, the total thickness of the multi-layered wafer support apparatus is less than or equal to the thickness of the wafer 107. The assembled multi-layered wafer support apparatus can be defined to be semi-rigid. It should be appreciated, however, that the top layer 301 is defined to have sufficient flexibility to allow for substantially flush engagement with the wafer 107 in the upper mask region 314, and substantially flush engagement with the bottom layer 201 beyond the periphery of the wafer 107.

Figure 4B:
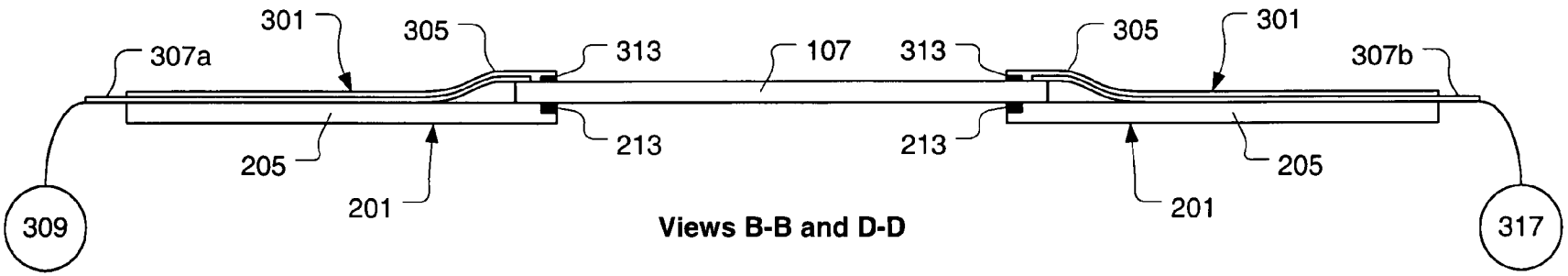
FIG. 4B is an illustration showing an assembly of the multi-layered wafer support apparatus, in accordance with one embodiment of the present invention.

FIG. 4B is an illustration showing an assembly of the multi-layered wafer support apparatus, in accordance with one embodiment of the present invention. The view depicted in FIG. 4B corresponds to View B-B of the bottom layer 201 as previously shown in FIG. 2C and View D-D of the top layer 301 as previously shown in FIG. 3C. It should be appreciated that each of the components of the bottom layer 201 and top layer 301, as illustrated in FIG. 4B, is the same as previously described with respect to FIGS. 2A and 3A, respectively.

Figure 5A:
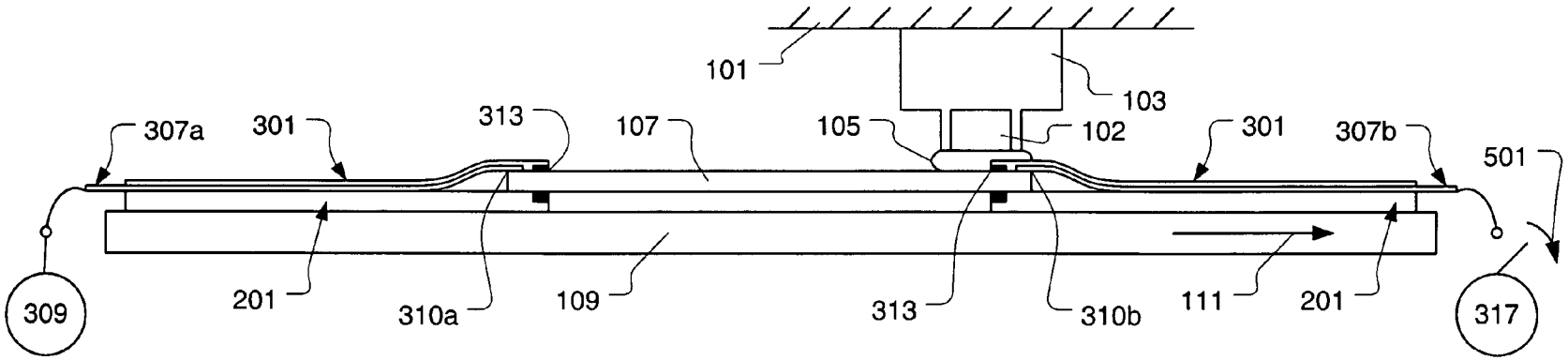
FIGS. 5A through 5D represent a sequence of illustrations showing operation of the electroplating apparatus, as previously described with respect to FIG. 1A, with use of the multi-layered wafer support apparatus, in accordance with one embodiment of the present invention.

FIGS. 5A through 5D represent a sequence of illustrations showing operation of the electroplating apparatus, as previously described with respect to FIG. 1A, with use of the multi-layered wafer support apparatus, in accordance with one embodiment of the present invention. FIG. 5A shows the apparatus shortly after initiation of the electroplating process. In FIG. 5A, the wafer 107 is being traversed underneath the anode 102 in the direction 111. The meniscus 105 is established below the anode 102. As shown in FIG. 5A, the sealant region 313 of the upper mask region 314 serves to protect the electrical contact location 310*b* from the meniscus 105 of electroplating solution as the anode 102 traverses thereabove. Also, the second electrical circuit 307*b* is electrically disconnected from its power supply 317, as indicated by arrow 501, as the anode 102 and meniscus 105 traverses over the electrical contact location 310*b*. Furthermore, the first electrical circuit 307*a* is electrically connected to its power supply 309. Thus, an electric current is caused to flow through the meniscus 105 and across the top surface of the wafer 107 between the anode 102 and the electrical contact location 310*a*.

Figure 5B:
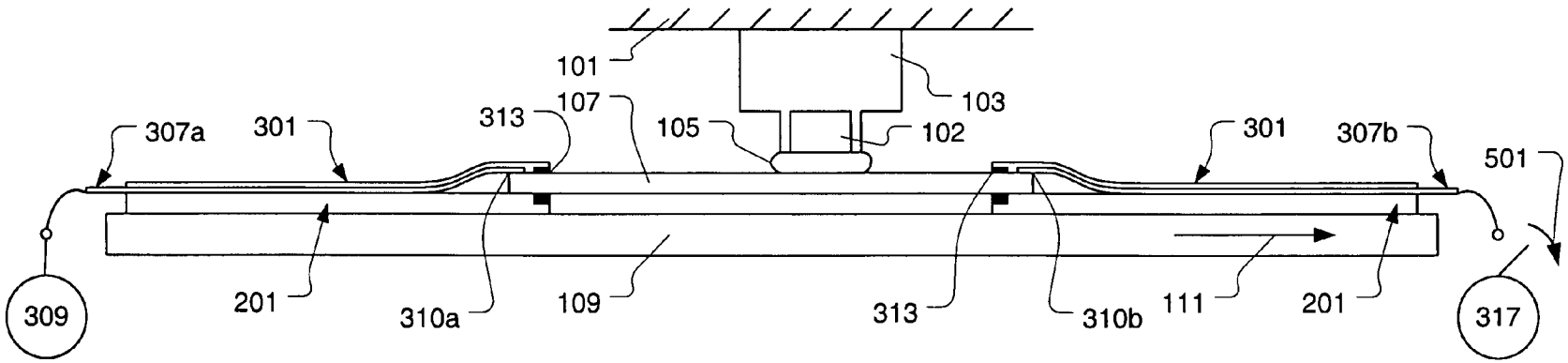

FIG. 5B shows the wafer 107 continuing to traverse underneath the anode 102 from the position depicted in FIG. 5A. The second electrical circuit 307*b* remains disconnected from its power supply 317 as the electrical contact location 310*b* moves away from the anode 102. In one embodiment, the second electrical circuit 307*b* is maintained in the disconnected state until the anode 102 and meniscus 105 is a sufficient distance away from the electrical contact location 310*b* to ensure that the electrical contact location 310*b* is not in the vicinity of electroplating solution.

Also, powering of the first and second electrical circuits 307*a*/307*b* is managed to optimize a current distribution present at the portion of the top surface of the wafer 107 that is in contact with the meniscus 105. In one embodiment, it is desirable to maintain a substantially uniform current density at an interface between the meniscus 105 and the wafer 107 as the wafer 107 traverses underneath the anode 102. It should be appreciated, that maintaining the anode 102 a sufficient distance away from the powered electrical contact location 310*a*/310*b*, i.e., the cathode, allows the current density at the interface between the meniscus 105 and the wafer 107 to be more uniform. Thus, in one embodiment, transition from powering the first electrical circuit 307*a* to powering the second electrical circuit 307*b* occurs when the anode 102 is substantially near a centerline of the top surface of the wafer 107, wherein the centerline is oriented to be perpendicular to the direction 111.

During transition from powering the first electrical circuit 307*a* to powering the second electrical circuit 307*b*, the power to the first electrical circuit 307*a* is maintained until power to the second electrical circuit 307*b* is established. Once the second electrical circuit 307*b* is powered, the first electrical circuit 307*a* is disconnected from its power supply 309. Maintaining power to at least one electrical circuit 307*a*/307*b* serves to minimize a potential for gaps or deviations in material deposition produced by the electroplating process.

Figure 5C:
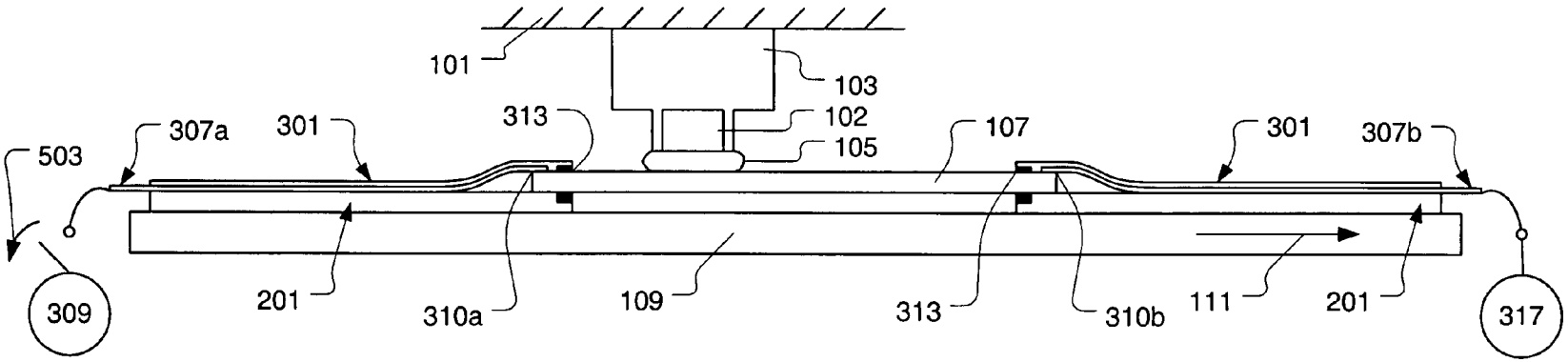

FIG. 5C shows the wafer 107 continuing to traverse underneath the anode 102, following transition from powering the first electrical circuit 307*a* to powering the second electrical circuit 307*b*. The second electrical circuit 307*b* is shown connected to its power supply 317. The first electrical circuit 307*a* is shown disconnected from its power supply 309, as indicated by arrow 503. The electric current flows through the meniscus 105 and across the top surface of the wafer 107 between the anode 102 and the electrical connection 310*b* to the second electrical circuit 307*b*.

Figure 5D:
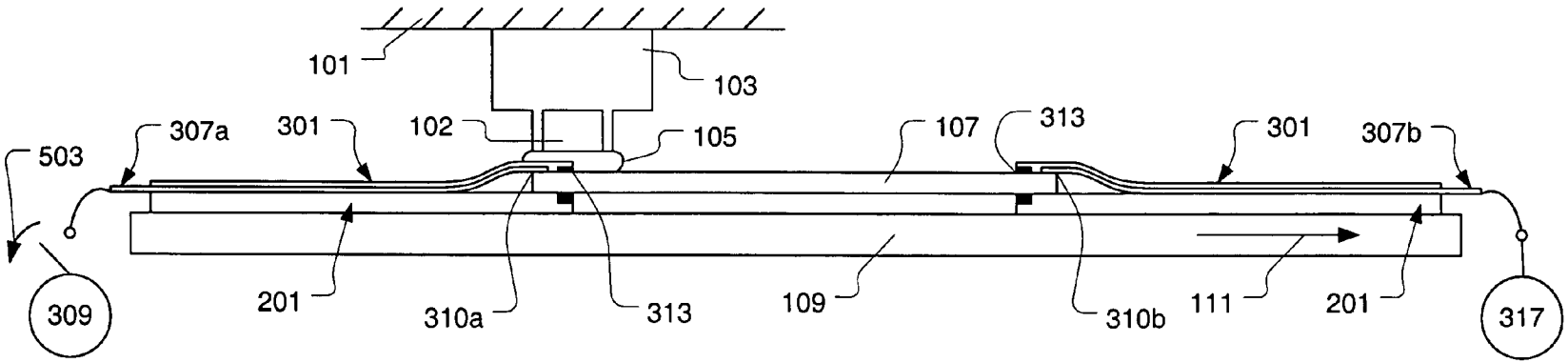

FIG. 5D shows the wafer 107 continuing to traverse underneath the anode 102 as the electroplating process nears completion. The sealant region 313 of the upper mask region 314 serves to protect the electrical contact location 310*a* from the meniscus 105 of electroplating solution as the anode 102 traverses thereabove. Also, the first electrical circuit 307*a* is disconnected from its power supply 309, as indicated by arrow 503, as the anode 102 and meniscus 105 traverses thereabove.

With reference to FIGS. 5A-5D, the multi-layered wafer support apparatus is depicted as being placed and held on the platen 109 during the electroplating process. The platen 109 is defined to have a flat surface with vacuum ports and index points. The platen 109 is formed from material that is chemically compatible with the multi-layered wafer support apparatus, wafer 107, and electroplating solution. In various embodiments, the platen 109 can be defined by stainless steel or engineering plastics such as PET and PVDF.

Vacuum ports in the platen 109 serve to hold the multi-layered wafer support apparatus flat against the platen 109 during the electroplating process. In one embodiment, the vacuum ports are evenly spaced across the platen 109 to enable the multi-layered wafer support apparatus to be uniformly held. Because the multi-layered wafer support apparatus is anticipated to be flexible, it is important that the vacuum ports be configured to provide a uniformly distributed securing force to avoid having unevenly distributed portions of the multi-layered wafer support apparatus.

Following the electroplating process, the top layer 301 can be peeled away from the wafer 107 to enable handling of the wafer 107 for further processing. In one embodiment, a rinse/ dry bar can be disposed adjacent to the processing head. In this embodiment, the rinse/dry bar functions to remove the used electroplating solution, clean the wafer 107, and dry the wafer 107. Additionally, it is conceivable that the multi-layered wafer support apparatus can be recondition following the electroplating process to enable repeated use.

Figure 6:
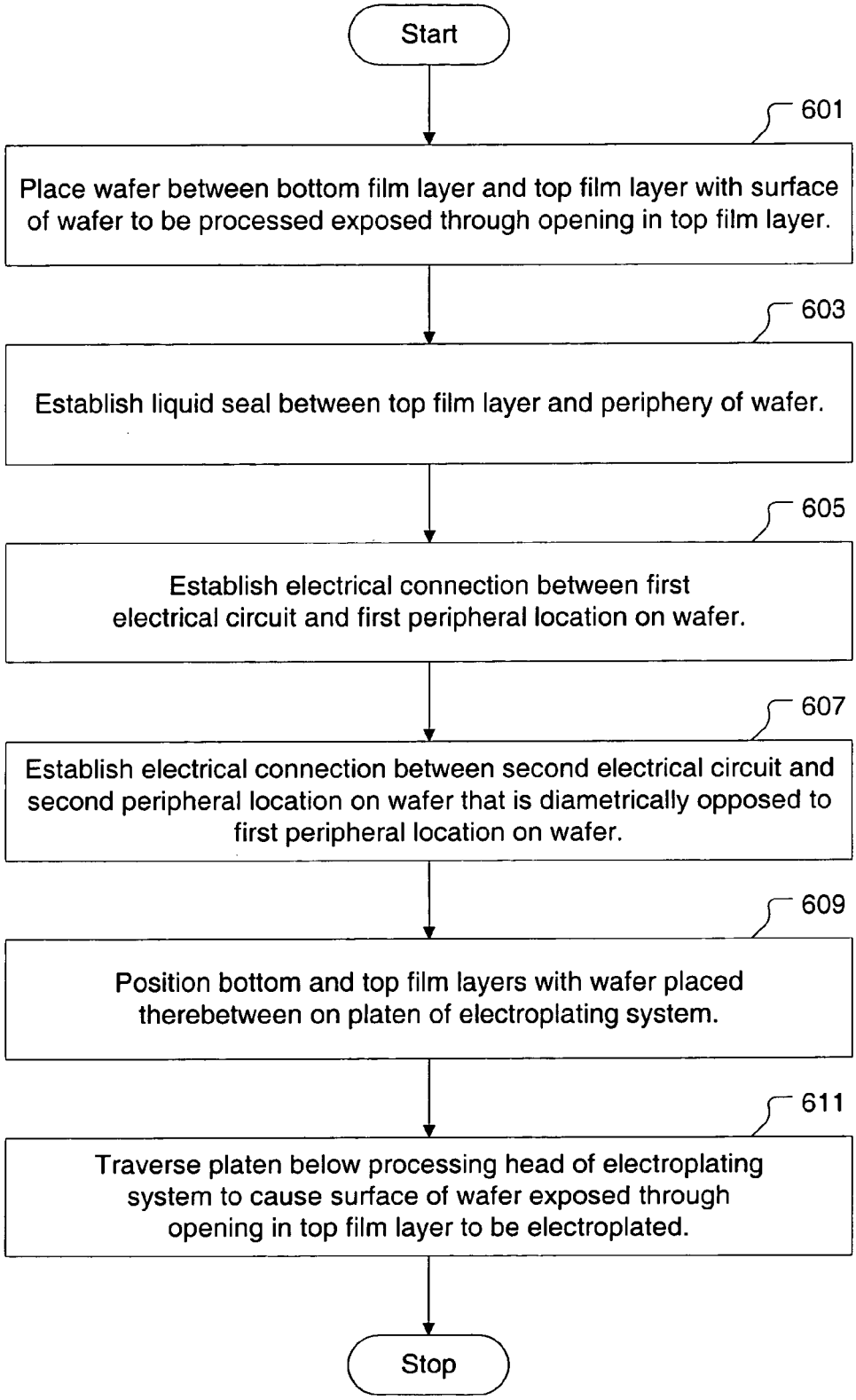
FIG. 6 is an illustration showing a flowchart of a method for supporting a wafer in an electroplating process, in accordance with one embodiment of the present invention.

FIG. 6 is an illustration showing a flowchart of a method for supporting a wafer in an electroplating process, in accordance with one embodiment of the present invention. An operation 601 is provided for placing a wafer between a bottom film layer and a top film layer, wherein a surface of the wafer to be processed, i.e., electroplated, is exposed through an opening in the top film layer. In one embodiment, each of the bottom and top film layers is defined as an amorphous film. In an operation 603, a liquid seal is established between the top film layer and a periphery of the wafer. An operation 605 is also provided for establishing an electrical connection between a first electrical circuit and a first peripheral location of the wafer. In one embodiment, the first electrical circuit is integral to the top film layer. In an operation 607, an electrical connection is established between a second electrical circuit and a second peripheral location of the wafer. The second peripheral location is diametrically opposed about the wafer to the first peripheral location. In one embodiment, the second electrical circuit is integral to the top film layer. An operation 609 is further provided for positioning the bottom and top film layers having the wafer placed therebetween on a platen of an electroplating system. Then, in an operation 611, the platen is traversed below a processing head of the electroplating system. The traversing of the platen causes the surface of the wafer exposed through the opening in the top film layer to be electroplated.

In one embodiment, the method for supporting the wafer in the electroplating process can further include the following operations:

- supplying power to the first electrical circuit when a portion of the wafer away from the first peripheral location is being processed,
- disconnecting power from the first electrical circuit when a portion of the wafer near the first peripheral location is being processed,
- supplying power to the second electrical circuit when a portion of the wafer away from the second peripheral location is being processed,
- disconnecting power from the second electrical circuit when a portion of the wafer near the second peripheral location is being processed, and
- supplying power to a sacrificial anode disposed within a region surrounding the wafer to maintain a uniform current density at a peripheral edge of the wafer, wherein the sacrificial anode is integral to the bottom film layer.

While this invention has been described in terms of several embodiments, it will be appreciated that those skilled in the art upon reading the preceding specifications and studying the drawings will realize various alterations, additions, permutations and equivalents thereof. Therefore, it is intended that the present invention includes all such alterations, additions, permutations, and equivalents as fall within the true spirit and scope of the invention.

What is claimed is:

1. A multi-layered wafer handling system for use in an electroplating process, comprising:

a bottom film layer including a wafer placement area and a sacrificial anode surrounding the wafer placement area; and a top film layer defined to be placed over the bottom film layer, the top film layer including an open region to be positioned over a surface of the wafer to be processed, the top film layer being defined to provide a liquid seal between the top film layer and the wafer to be processed about a periphery of the open region, the top film layer including first and second electrical circuits defined to electrically contact a peripheral top surface of the wafer to be processed at diametrically opposed locations.

2. The multi-layered wafer handling system of claim 1, wherein each of the first and second electrical circuits is independently controllable and isolated from the sacrificial anode of the bottom film layer.

3. The multi-layered wafer handling system of claim 1, wherein each of the sacrificial anode, the first electrical circuit, and the second electrical circuit is configured to connect with a respective power supply via a respective externally accessible electrical contact.

4. The multi-layered wafer handling system of claim 1, wherein the wafer placement area of the bottom film layer is defined by a circular open area having a diameter less than that of the wafer to be processed, and a mask region defined about an edge of the open region, the mask region including an sealant region defined to form a liquid seal between the bottom film layer and the wafer to be processed.

5. The multi-layered wafer handling system of claim 1, wherein each of the bottom and top film layers is defined as an amorphous film.

6. The multi-layered wafer handling system of claim 5, wherein the amorphous film is either Ajedium Victrex PEEK, polyetherimide (PEI), polysulfone (PSU), polyphenylsulfide (PPS), or any of the aforementioned amorphous films clad or impregnated with copper.

7. The multi-layered wafer handling system of claim 1, wherein each of the bottom and top film layers includes a number of aligned index points to facilitate placement and positioning of the multi-layered wafer handling system within an electroplating system.

8. A wafer support apparatus for use in an electroplating process, comprising:

a first material layer having an area for receiving a wafer to be processed;

a sacrificial anode defined over the first material layer;

a second material layer configured to overlie a peripheral region of the wafer and the first material layer outside the peripheral region of the wafer, the second material layer including a cutout to expose a surface of the wafer to be processed, the second material layer being further configured to form a seal between the second material layer and the peripheral region of the wafer; and a pair of circuits integrated within the second material layer, each circuit in the pair of circuits including an electrical contact defined to electrically connect with the surface of the wafer to be processed, the pair of circuits being electrically isolated from the sacrificial anode.

9. The wafer support apparatus of claim 8, wherein the sacrificial anode is embedded within the first material layer.

10. The wafer support apparatus of claim 8, further comprising:

an adhesive defined to form the seal between the second material layer and the peripheral region of the wafer to be processed.

11. The wafer support apparatus of claim 8, wherein the first and second material layers include aligned index points to facilitate placement and positioning of the first and second material layers within an electroplating system.

12. The wafer support apparatus of claim 8, wherein each circuit in the pair of circuits is defined to connect with the surface of the wafer to be processed at diametrically opposed locations about a periphery of the wafer.

13. The wafer support apparatus of claim 8, wherein the sacrificial anode is configured to connect with a first power supply, the pair of circuits being configured to connect with a second power supply, and the first and second power supplies being independently controllable.

14. The wafer support apparatus of claim 8, wherein the first material layer further includes, a circular cutout having a diameter less than a diameter of a wafer to be processed, and a mask region defined around the cutout, the mask region being defined between an edge of the cutout and an edge of the wafer to be placed in a centered position over the cutout, the mask region including an adhesive defined to form a seal between first material layer and the wafer.

15. The wafer support apparatus of claim 8, wherein each of the first and second material layers is defined as an amorphous film.

16. The wafer support apparatus of claim 15, wherein the amorphous film is either Ajedium Victrex PEEK, polyetherimide (PEI), polysulfone (PSU), polyphenylsulfide (PPS), or any of the aforementioned amorphous films clad or impregnated with copper.

* * * * *